US011705256B2

(12) United States Patent
Xia et al.

(10) Patent No.: US 11,705,256 B2
(45) Date of Patent: Jul. 18, 2023

(54) NEODYMIUM-IRON-BORON PERMANENT MAGNET AND PREPARATION METHOD AND USE THEREOF

(71) Applicant: Baotou Jinshan Magnetic Material Co., Ltd., Inner Mongolia (CN)

(72) Inventors: Feng Xia, Inner Mongolia (CN); Yu Wang, Inner Mongolia (CN); Yanli Li, Inner Mongolia (CN); Yonghuai Feng, Inner Mongolia (CN); Chunguang Liu, Inner Mongolia (CN); Haiyuan Zhang, Inner Mongolia (CN); Jixiang Liu, Inner Mongolia (CN); Manyou Su, Inner Mongolia (CN); Gazhen Liu, Inner Mongolia (CN)

(73) Assignee: BAOTOU JINSHAN MAGNETIC MATERIAL CO., LTD., Inner Mongolia (CN)

( * ) Notice: Subject to any disclaimer, the term of this patent is extended or adjusted under 35 U.S.C. 154(b) by 0 days.

(21) Appl. No.: 17/381,846

(22) Filed: Jul. 21, 2021

(65) Prior Publication Data

US 2022/0384071 A1 Dec. 1, 2022

(30) Foreign Application Priority Data

May 31, 2021 (CN) ..... 202110602728.1

(51) Int. Cl.

| | |
|---|---|
| ***H01F 1/057*** | (2006.01) |
| ***B22F 3/24*** | (2006.01) |
| ***C22C 33/02*** | (2006.01) |
| ***C22C 38/00*** | (2006.01) |
| ***H01F 41/02*** | (2006.01) |
| ***B22F 9/04*** | (2006.01) |

(52) U.S. Cl.

CPC ..... *H01F 1/0577* (2013.01); *B22F 3/24* (2013.01); *C22C 33/02* (2013.01); *C22C 38/002* (2013.01); *C22C 38/005* (2013.01); *H01F 41/0266* (2013.01); *B22F 9/04* (2013.01); *B22F 2003/248* (2013.01); *B22F 2009/044* (2013.01); *B22F 2202/05* (2013.01); *B22F 2301/355* (2013.01); *B22F 2998/10* (2013.01); *C22C 2202/02* (2013.01)

(58) Field of Classification Search

CPC ..... H01F 1/0577; H01F 41/0266; B22F 3/24; B22F 2003/248; B22F 2009/044; B22F 2202/05; B22F 2301/35; B22F 2998/10; C22C 33/02; C22C 38/002; C22C 38/005; C22C 2202/02

See application file for complete search history.

(56) References Cited

FOREIGN PATENT DOCUMENTS

| | | | |
|---|---|---|---|
| CN | 108447638 A | 8/2018 | |
| WO | WO-2021098223 A1 * | 5/2021 | ..... C22C 38/002 |

OTHER PUBLICATIONS

The First Chinese Office Action for Chinese Patent Application No. 2021106027281, dated Jun. 7, 2022, CNIPA, China.

* cited by examiner

*Primary Examiner* — Brian D Walck
*Assistant Examiner* — Nazmun Nahar Shams
(74) *Attorney, Agent, or Firm* — M&B IP Analysts, LLC

(57) ABSTRACT

A neodymium-iron-boron permanent magnet, a preparation method and use thereof are disclosed. The neodymium-iron-boron permanent magnet has a composition represented by formula I: $[mHR(1-m)(Pr_{25}Nd_{75})]_x(Fe_{100-a-b-c-d}M_aGa_bIn_cSn_d)_{100-x-y}B_y$, formula I; where a is 0.995-3.493, b is 0.114-0.375, c is 0.028-0.125, d is 0.022-0.100; x is 29.05-30.94, y is 0.866-1.000; m is 0.02-0.05; HR is Dy and/or Tb; M is at least one selected from the group consisting of Co, Cu, Ti, Al, Nb, Zr, Ni, W and Mo.

11 Claims, No Drawings

NEODYMIUM-IRON-BORON PERMANENT MAGNET AND PREPARATION METHOD AND USE THEREOF

CROSS REFERENCE TO RELATED APPLICATION

This application claims the benefit and priority of Chinese Patent Application No. 202110602728.1 filed on May 31, 2021, the content of which is incorporated by reference herein in its entirety as part of the present application.

TECHNICAL FIELD

The present disclosure relates to the technical field of permanent magnets, and in particular to a neodymium-iron-boron permanent magnet and a preparation method and use thereof.

BACKGROUND ART

With the miniaturization of high-technology electronic information products and new energy auto parts, the development of sintered neodymium-iron-boron permanent magnets with high remanence and high coercive force has become the mainstream research direction in the future. In the prior art, a preparation of neodymium-iron-boron permanent magnets generally involves a certain amount of organic additives such as organic antioxidants, organic lubricants, and organic release agents, which directly leads to an increase of contents of carbon and oxygen in neodymium-iron-boron permanent magnets, and greatly limits the performance of sintered neodymium-iron-boron permanent magnets with high remanence and high coercive force. In addition, in the preparation of neodymium-iron-boron permanent magnets in the prior art, in order to increase the density of the product, it is necessary to introduce a cold isostatic pressing after molding, which has a high manufacturing cost.

SUMMARY

An object of the present disclosure is to provide a neodymium-iron-boron permanent magnet and a preparation method and use thereof. The neodymium-iron-boron permanent magnet provided by the present disclosure has low contents of carbon and oxygen, and exhibits an excellent comprehensive performance; according to the present disclosure, high-density products could be obtained without a cold isostatic pressing process after the molding process, which saves manufacturing costs.

In order to achieve the above object, the present disclosure provides the following technical solutions:

The present disclosure provides a neodymium-iron-boron permanent magnet, having a composition represented by formula I:

$$[mHR(1-m)(Pr_{25}Nd_{75})]_x(Fe_{100-a-b-c-d}M_aGa_bIn_cSn_d)_{100-x-y}B_y \quad \text{formula I;}$$

where a is 0.995-3.493, b is 0.114-0.375, c is 0.028-0.125, d is 0.022-0.100; x is 29.05-30.94, y is 0.866-1.000; m is 0.02-0.05;

HR is Dy and/or Tb; and

M is at least one selected from the group consisting of Co, Cu, Ti, Al, Nb, Zr, Ni, W and Mo.

The present disclosure provides a method for preparing the neodymium-iron-boron permanent magnet as described above, comprising the following steps:

providing a strip casting alloy flake and a liquid alloy according to a composition of the neodymium-iron-boron permanent magnet, wherein the strip casting alloy flake consists of HR, Pr, Nd, Fe, M and B, and the liquid alloy consists of Ga, In and Sn;

sequentially subjecting the strip casting alloy flake to a hydrogen decrepitation and a powdering with a jet mill, to obtain a powdered alloy; and mixing the powdered alloy with the liquid alloy to obtain a mixed material, and sequentially subjecting the mixed material to an orientation molding, a sintering, and a tempering treatment, to obtain the neodymium-iron-boron permanent magnet.

In some embodiments, the liquid alloy has a composition of $Ga_eIn_fSn_g$, where e is 57-75, f is 14-25, and g is 11-18.

In some embodiments, the liquid alloy is prepared by a process comprising the following steps:

mixing metals Ga, In and Sn in a protective atmosphere with a pressure of 0.05-0.15 MPa and an oxygen content less than 0.02%, and at a temperature of 25-35° C., to obtain the liquid alloy.

In some embodiments, the hydrogen decrepitation includes an activation treatment, a hydrogen absorption treatment, and a dehydrogenation treatment in sequence, wherein the activation treatment is conducted at 80-150° C. for 30-60 min;

the hydrogen absorption treatment is conducted at a pressure not higher than 0.088 Pa, and for 600 kg of the strip casting alloy flake, the hydrogen absorption treatment is conducted for 50-70 min;

the dehydrogenation treatment is conducted at 480-650° C., and for 600 kg of the strip casting alloy flake, the dehydrogenation treatment is conducted for 2-5 h.

In some embodiments, the powdering with a jet mill is conducted in an atmosphere with an oxygen supplement of less than 10 ppm at a rotational speed of a classifying wheel of 4200-4300 r/min; the powdered alloy has an average particle size d [5,0] of 3.5-4.5 μm and a particle size distribution d [9,0]/d [1,0] of 3.8-4.2.

In some embodiments, the orientation molding is conducted at a magnetic flux density of 1.5-2 T; a green body obtained by the orientation molding has a density of 4.2-4.5 g/cm$^3$.

In some embodiments, the sintering is conducted at a vacuum degree not higher than $3\times10^{-3}$ Pa and a temperature of 1030-1100° C. for 2-8 h.

In some embodiments, the tempering treatment includes a first tempering treatment and a second tempering treatment in sequence; the first tempering treatment is conducted at 850-920° C. for 2-5 h; the second tempering treatment is conducted at 470-550° C. for 3-8 h.

The present disclosure provides use of the neodymium-iron-boron permanent magnet in the above technical solution, or the neodymium-iron-boron permanent magnet prepared by the above method in the above technical solution in electronic information products or new energy automobile motor products.

The present disclosure provides a neodymium-iron-boron permanent magnet with a composition represented by formula I. In the present disclosure, Ga, In and Sn are added into the neodymium-iron-boron permanent magnet, thus avoiding the problem of high contents of carbon and oxygen in the neodymium-iron-boron permanent magnet caused by the introduction of organic additives in the prior art, and resulting in a neodymium-iron-boron permanent magnet with an excellent comprehensive performance; in addition, according to the present disclosure, a high-density product could be obtained without any additional cold isostatic pressing process after the molding process, which saves manufacturing costs. The results of the examples show that the neodymium-iron-boron permanent magnet provided by the present disclosure is a 52H neodymium-iron-boron permanent magnet with high remanence and high coercive force, and has a remanence up to 14.4 kGs at 20° C. and an intrinsic coercive force up to 18.5 kOe, which is conductive to enhancing the competitiveness of neodymium-iron-boron permanent magnets in the high-technology application market.

The present disclosure also provides a method for preparing the neodymium-iron-boron permanent magnet, comprising the following steps: providing a strip casting alloy flake and a liquid alloy according to a composition of the neodymium-iron-boron permanent magnet, wherein the strip casting alloy flake consists of HR, Pr, Nd, Fe, M and B, and the liquid alloy consists of Ga, In and Sn; sequentially subjecting the strip casting alloy flakes to a hydrogen decrepitation and a powdering with a jet mill to obtain a powdered alloy; mixing the powdered alloy with the liquid alloy to obtain a mixed material, and sequentially subjecting the mixed material to an orientation molding, a sintering and a tempering treatment, to obtain the neodymium-iron-boron permanent magnet. In the method for preparing a neodymium-iron-boron permanent magnet, Ga, In and Sn are added as a liquid alloy, which avoids the problems of high contents of carbon and oxygen in neodymium-iron-boron permanent magnets caused by the introduction of organic additives such as organic antioxidants after the hydrogen decrepitation, organic lubricants after the powdering with a jet mill, and organic release agents during the orientation molding process in the prior art; in addition, according to the present disclosure, a neodymium-iron-boron permanent magnet with excellent comprehensive performance could be obtained without any additional cold isostatic pressing process after the molding process, which saves manufacturing costs.

DETAILED DESCRIPTION OF THE EMBODIMENTS

The present disclosure provides a neodymium-iron-boron permanent magnet, having a composition represented by formula I:

$$[m\mathrm{HR}(1-m)(\mathrm{Pr}_{25}\mathrm{Nd}_{75})]_x(\mathrm{Fe}_{100-a-b-c-d}\mathrm{M}_a\mathrm{Ga}_b\mathrm{In}_c\mathrm{Sn}_d)_{100-x-y}\mathrm{B}_y \quad \text{formula I;}$$

where, a is 0.995-3.493, b is 0.114-0.375, c is 0.028-0.125, d is 0.022-0.100; x is 29.05-30.94, y is 0.866-1.000; m is 0.02-0.05;

HR is Dy and/or Tb; and

M is at least one selected from the group consisting of Co, Cu, Ti, Al, Nb, Zr, Ni, W and Mo.

In some embodiments, in formula I, a is 0.135-0.253, b is 0.193-0.252, c is 0.058-0.086, d is 0.045-0.073; x is 29.65-30.34, y is 0.902-0.962; m is 0.03-0.04; HR may be Dy or Tb, or a mixture of Dy and Tb, and specifically, under the condition that HR is a mixture of Dy and Tb, a molar ratio of Dy to Tb is preferably (0.008-0.012):(0.02-0.03), and more preferably 0.01:0.025; M may be Co, Cu, Ti, Al, Nb, Zr, Ni, W or Mo, or a mixture of Co, Cu and Nb, or a mixture of Co, Cu and Zr, and specifically, under the condition that M is a mixture of Co, Cu and Nb, a molar ratio of Co, Cu, and Nb is preferably (1.0-1.5):(0.1-0.3):(0.20-0.25), and more preferably 1.2:0.2:0.23; under the condition that M is a mixture of Co, Cu and Zr, a molar ratio of Co, Cu and Zr is preferably (1.0-1.5):(0.10-0.25):(0.15-0.25), and more preferably 1.2:(0.15-0.20):(0.18-0.20).

The present disclosure provides a method for preparing the neodymium-iron-boron permanent magnet as described in the above technical solution, comprising the following steps:

providing a strip casting alloy flake and a liquid alloy according to a composition of the neodymium-iron-boron permanent magnet, wherein the strip casting alloy flake consists of HR, Pr, Nd, Fe, M and B, and the liquid alloy consists of Ga, In and Sn;

sequentially subjecting the strip casting alloy flake to a hydrogen decrepitation and a powdering with a jet mill to obtain a powdered alloy; and mixing the powdered alloy with the liquid alloy to obtain a mixed material, and sequentially subjecting the mixed material to an orientation molding, a sintering, and a tempering treatment, to obtain the neodymium-iron-boron permanent magnet.

The present disclosure provides a strip casting alloy flake and a liquid alloy according to a composition of the neodymium-iron-boron permanent magnet, wherein the strip casting alloy flake consists of HR, Pr, Nd, Fe, M and B, and the liquid alloy consists of Ga, In and Sn. In the present disclosure, the compositions of the strip casting alloy flake and the liquid alloy and the ratio thereof are based on the neodymium-iron-boron permanent magnet represented by formula I. In some embodiments, the liquid alloy has a composition of $\mathrm{Ga}_e\mathrm{In}_f\mathrm{Sn}_g$, where e is 57-75, f is 14-25, and g is 11-18; preferably, e is 60-65, f is 18-20, g is 13-15; in some embodiments of the present disclosure, the liquid alloy may specifically has a composition of $\mathrm{Ga}_{65}\mathrm{In}_{20}\mathrm{Sn}_{15}$. In some embodiments, the strip casting alloy flake has a composition of $[m\mathrm{HR}(1-m)\mathrm{Pr}_{25}\mathrm{Nd}_{75}]_n(\mathrm{Fe}_{100-n}\mathrm{M}_n)_{100-h-i}\mathrm{B}_i$, where n is 1.0-3.5, his 29.2-31.0, i is 0.87-1.00, and the value range of m and the optional types of HR and M are consistent with those in the composition represented by formula I, and thus they will not be described in more detail here; in some embodiments, m is 0.025-0.035, n is 1.5-2.0, h is 29.6-30.8, and i is 0.90-0.96; preferably, m is 0.01-0.02, n is 1.53-1.63, h is 29.8-30.0, and i is 0.92-0.95. In some embodiments of the present disclosure, the strip casting alloy flake may specifically has a composition selected from the group consisting of:

$[0.025\mathrm{Dy}0.975(\mathrm{Pr}_{25}\mathrm{Nd}_{75})]_{29.8}(\mathrm{Fe}_{98.37}\mathrm{Co}_{1.2}\mathrm{Cu}_{0.2}\mathrm{Nb}_{0.23})_{69.24}\mathrm{B}_{0.96}$;

$[0.05\mathrm{Tb}0.95(\mathrm{Pr}_{25}\mathrm{Nd}_{75})]_{29.6}(\mathrm{Fe}_{98.47}\mathrm{Co}_{1.2}\mathrm{Cu}_{0.15}\mathrm{Zr}_{0.18})_{69.45}\mathrm{B}_{0.95}$;

$[0.02\mathrm{Tb}0.98(\mathrm{Pr}_{25}\mathrm{Nd}_{75})]_{29.8}(\mathrm{Fe}_{98.4}\mathrm{Co}_{1.2}\mathrm{Cu}_{0.2}\mathrm{Zr}_{0.2})_{69.25}\mathrm{B}_{0.95}$; and $[0.01\mathrm{Tb}0.025\mathrm{Dy}0.965(\mathrm{Pr}_{25}\mathrm{Nd}_{75})]_{29.8}(\mathrm{Fe}_{98.4}\mathrm{Co}_{1.2}\mathrm{Cu}_{0.2}\mathrm{Zr}_{0.2})_{69.25}\mathrm{B}_{0.95}$.

In some embodiments, the strip casting alloy flake has a thickness of 0.15-0.5 mm; in some embodiments of the present disclosure, the strip casting alloy flake has an average thickness of 0.2 mm. In some embodiments of the present disclosure, the strip casting alloy flake is prepared by a process including: compounding according to the ingredients of the strip casting alloy flake, and then casting. In some embodiments of the present disclosure, the casting is conducted in argon at a pressure not higher than $3\times10^4$ Pa; the casting is conducted at a rotational speed of a copper roller of 35-58 r/min, and preferably 41-46 r/min; the casting is conducted at a temperature of 1350-1600° C., preferably 1420-1500° C. In some embodiments of the present disclosure, the casting is specifically conducted in a strip casting furnace.

In some embodiments of the present disclosure, the liquid alloy is prepared by a process comprising:

mixing metals Ga, In and Sn in a protective atmosphere with a pressure of 0.05-0.15 MPa, and an oxygen content less than 0.02% at a temperature of 25-35° C., to obtain the liquid alloy.

In some embodiments of the present disclosure, the liquid alloy is prepared in a glove box, and specifically, prepared by the following steps: vacuumizing the glove box to a vacuum degree less than 1 Pa, and then introducing a protective gas to the glove box to result in a content of oxygen in the glove box less than 0.02%, and a pressure of 0.05-0.15 MPa (provided by the protective gas); at 25-35° C., adding metals Ga, In and Sn to the glove box and mixing to obtain the liquid alloy.

In the present disclosure, there is no specifical limitation on the protective gas, and any protective gas well known to those skilled in the art may be used, for example, nitrogen. In some embodiments of the present disclosure, the metals Ga, In and Sn independently have a purity not lower than 99.95%, and the ratio of metals Ga, In and Sn may be selected according to the required composition of the liquid alloy. In some embodiments, the mixing is conducted by stirring for 25-35 min, and preferably 30 min; in the present disclosure, there is no specifical limitation on the rotational speed of the stirring, as long as the components could be mixed uniformly. In some embodiments, the mixing is conducted at 28-30° C.

After obtaining the strip casting alloy flake, the strip casting alloy flake is sequentially subjected to a hydrogen decrepitation and a powdering with a jet mill, to obtain a powdered alloy. In some embodiments, the hydrogen decrepitation includes an activation treatment, a hydrogen absorption treatment and a dehydrogenation treatment in sequence; in some embodiments, the activation treatment is conducted at 80-150° C., preferably 100-120° C., and the activation treatment is conducted for 30-60 min, preferably 40-50 min; in some embodiments, the hydrogen absorption treatment is conducted at a pressure not higher than 0.088 Pa, preferably 0.085-0.088 Pa, and for 600 kg of the strip casting alloy flake, the hydrogen absorption treatment is conducted for 50-70 min, preferably 55-60 min. In some embodiments, the dehydrogenation treatment is conducted at 480-650° C., preferably 530-580° C., and for 600 kg of the strip casting alloy flake, the dehydrogenation treatment is conducted for 2-5 h, preferably 3-4 h. In the present disclosure, a hydrogen decrepitated material is obtained after the hydrogen decrepitation, and the hydrogen decrepitated material has a particle size of 50-300 μm. In some embodiments of the present disclosure, the hydrogen decrepitation is specifically conducted in a hydrogen decrepitation furnace. The hydrogen decrepitation process according to the present invention does not involve any additive.

After obtaining the hydrogen decrepitated material, the hydrogen decrepitated material is subjected to a powdering with a jet mill, to obtain a powdered alloy. In some embodiments, the powdering with a jet mill is conducted in an atmosphere with an oxygen supplement less than 10 ppm; the powdering with a jet mill is conducted at a rotational speed of a classifying wheel of 4200-4300 r/min. In some embodiments, the powdered alloy has an average particle size d [5, 0] of 3.5-4.5 μm, preferably 3.8-4.0 μm and a particle size distribution d [9,0]/d [1,0] of 3.8-4.2, preferably 4.0-4.1. The powdering with a jet mill according to present disclosure does not involve any additive.

After obtaining the powdered alloy and the liquid alloy, the powdered alloy and the liquid alloy are mixed to obtain a mixed material. In the present disclosure, the ratio of the powdered alloy to the liquid alloy may be selected according to the composition of the neodymium-iron-boron permanent magnet, and specifically, in some embodiments, the mass of the liquid alloy is 0.20-0.45% of that of the powdered alloy, preferably 0.30-0.35%. In the present disclosure, there is no special limitation on the mixing, as long as the powdered alloy and liquid alloy could be mixed to be uniform. In some embodiments of the present disclosure, the mixing is specifically conducted in a fully automatic three-dimensional mixer for 30-200 min, preferably 60-90 min; in some embodiments, during the mixing, the mixer has a tank wall temperature not higher than 25° C., preferably 15-20° C., more preferably 16-19° C., and furthermore preferably 17-18° C. In the present disclosure, it is beneficial to improve the anti-oxidation effect by mixing at a low temperature.

After obtaining the mixed material, the mixed material is subjected to an orientation molding to obtain a green body. In some embodiments, the orientation molding is conducted at a magnetic flux density of 1.5-2 T. In some embodiments, the green body has a density of 4.2-4.5 g/cm$^3$. In some embodiments of the present disclosure, the orientation molding is conducted in a magnetic field pressure equipment. In the present disclosure, after the orientation molding, a high-density green body could be obtained without any cold isostatic pressing process.

After obtaining the green body, the green body is subjected to a sintering to obtain a sintered material. In some embodiments, the sintering is conducted under a vacuum degree not higher than $3\times10^{-3}$ Pa. In some embodiments, the sintering is conducted at 1030-1100° C., preferably 1050-1075° C., and the sintering is conducted for 2-8 h, preferably 4-6 h. In some embodiments, the temperature required by the sintering is obtained by raising ambient temperature at a first heating rate, and the first heating rate is in a range of 3-5° C./min, preferably 4° C./min; in some embodiments of the present disclosure, the ambient temperature is specifically 25° C. In some embodiment of the present disclosure, the sintering is specifically conducted in a sintering furnace.

After obtaining the sintered material, the sintered material is subjected to a tempering treatment to obtain a neodymium-iron-boron permanent magnet. In some embodiments, the tempering treatment includes a first tempering treatment and a second tempering treatment in sequence. In some embodiments, the first tempering treatment is conducted at 850-920° C., preferably 870-900° C., and the first tempering treatment is conducted for 2-5 h, preferably 3-4 h; the second tempering treatment is conducted at 470-550° C., preferably 500-520° C., and the second tempering treatment is conducted for 3-8 h, preferably 4-5 h. In some embodiments, after the sintering, the temperature is reduced to 70-80° C. at a first cooling rate, and then the temperature is raised to the temperature required for the first tempering treatment at a second heating rate to undergo the first tempering treatment; after the first tempering treatment, the temperature is reduced to 70-80° C. at a second cooling rate, and then the temperature is raised to the temperature required for the second tempering treatment at a third heating rate to undergo the second tempering treatment; after the second tempering treatment, the temperature is reduced to a temperature less than 40° C. at a third cooling rate. In some embodiments, the first cooling rate is in a range of 15-20° C./min, the second heating rate is in a range of 8-10° C./min, the second cooling rate is in a range of 15-20° C./min, the third heating rate is in a range of 10-15° C./min, and the third cooling rate is in a range of 10-15° C./min.

The present disclosure also provides use of the neodymium-iron-boron permanent magnet described in the above technical solutions or the neodymium-iron-boron permanent magnet prepared by the methods described in the above technical solutions in electronic information products or new energy automobile motor products. In the present disclosure, there is no special limitation on the methods for the use, and any method well known to those skilled in the art may be used.

The technical solutions of the present disclosure will be clearly and completely described below in conjunction with the examples of the present disclosure. Obviously, the described examples are only a part of the embodiments of the present disclosure, rather than all the embodiments. Based on the examples of the present disclosure, all other embodiments obtained by those of ordinary skill in the art without creative work shall fall within the protection scope of the present disclosure.

Example 1

A neodymium-iron-boron permanent magnet was prepared as follows:

The raw materials were compounded according to the composition of $[0.025Dy0.975(Pr_{25}Nd_{75})]_{29.8}(Fe_{98.37}Co_{1.2}Cu_{0.2}Nb_{0.23})_{69.24}B_{0.96}$, and the resulting mixture was casted in a strip casting furnace in argon at a pressure not higher than $3\times10^4$ Pa and a rotational speed of a copper roller of 41 r/min and a temperature of 1420° C., obtaining a strip casting alloy flake with an average thickness of 0.25 mm.

The strip casting alloy flake was placed in a hydrogen decrepitation furnace, and subjected to an activation treatment, a hydrogen absorption treatment and a dehydrogenation treatment sequentially, obtaining a hydrogen decrepitated material with a particle size of 50-300 μm, wherein the activation treatment was conducted at 100° C. for 40 min, the hydrogen absorption treatment was conducted at a pressure of 0.088 Pa and for 600 kg of the strip casting alloy flake, the hydrogen absorption treatment was conducted for 1 h, and the dehydrogenation treatment was conducted at 580° C., and for 600 kg of the strip casting alloy flake, dehydrogenation treatment was conducted for 3 h.

The hydrogen decrepitated material was subjected to a powdering with a jet mill in an atmosphere with an oxygen supplement less than 10 ppm at a rotational speed of a classifying wheel of 4300 r/min, obtaining a powdered alloy with an average particle size d [5,0] of 3.8 μm and a particle size distribution d [9,0]/d [1,0] of 4.0.

A glove box was vacuumized to a vacuum degree less than 1 Pa, and then the glove box was charged with nitrogen to obtain a content of oxygen in the glove box less than 0.02% and a pressure of 0.1 MPa (provided by nitrogen). At a temperature of 30° C., metal Ga (with a purity not lower than 99.95%), metal In (with a purity not lower than 99.95%) and metal Sn (with a purity not lower than 99.95%) were added into the glove box according to the composition of $Ga_{65}In_{20}Sn_{15}$, and the resulting mixture was stirred for 0.5 h to obtain a liquid alloy.

The powdered alloy and the liquid alloy were fully stirred in a fully automatic three-dimensional mixer for 1 h, during which the mixer had a tank wall temperature of 19° C., obtaining a mixed material, wherein the mass of the liquid alloy was 0.2% of that of the powdered alloy.

The mixed material was placed in a magnetic field pressure equipment and subjected to an orientation molding at a magnetic flux density of 2 T, obtaining a green body with a density of 4.21 g/cm$^3$.

The green body was placed in a sintering furnace with a vacuum degree not higher than $3\times10^{-2}$ Pa and subjected to a sintering, which is specifically conducted as follows: the temperature in the sintering furnace was increased from ambient temperature (25° C.) to 1075° C. at a heating rate of 4° C./min, and the body was held for 6 h at this temperature, obtaining a sintered material; then the temperature was reduced to 75° C. at a cooling rate of 15° C./min, and then increased to 900° C. at a heating rate of 8° C./min, and the sintered material was held for 4 h at this temperature for a first tempering treatment; then the temperature was reduced to 75° C. at a cooling rate of 15° C./min, and then increased to 500° C. at a heating rate of 10° C./min, and the resulting material after the first tempering treatment was held for 5 h at this temperature for a second tempering treatment, and finally the temperature was reduced to 25° C. at a cooling rate of 10° C./min, obtaining the neodymium-iron-boron permanent magnet.

Example 2

A neodymium-iron-boron permanent magnet was prepared according to the method of Example 1, except that the mass of the liquid alloy was 0.35% of that of the powdered alloy, and during the mixing process of the powdered alloy and the liquid alloy $Ga_{65}In_{20}Sn_{15}$, the mixer had a tank wall temperature of 17° C.

Example 3

A neodymium-iron-boron permanent magnet was prepared according to the method of Example 1, except that the mass of the liquid alloy was 0.45% of the mass of the powdered alloy, and during the mixing process of the powdered alloy and the liquid alloy $Ga_{65}In_{20}Sn_{15}$, the mixer had a tank wall temperature of 16° C.

Comparative Example 1

A neodymium-iron-boron permanent magnet was prepared as follows:

The raw materials were compounded according to the composition of $[0.025Dy0.975(Pr_{25}Nd_{75})]_{29.8}(Fe_{98.37}Co_{1.2}Cu_{0.2}Nb_{0.23})_{69.24}B_{0.96}$, and the resulting mixture was casted in a strip casting furnace in argon at a pressure not higher than $3\times10^4$ Pa and a rotational speed of a copper roller of 41 r/min and a temperature of 1420° C., obtaining a strip casting alloy flake with an average thickness of 0.25 mm.

The strip casting alloy flake was placed in a hydrogen decrepitation furnace, and subjected to an activation treatment, a hydrogen absorption treatment and a dehydrogenation treatment sequentially, obtaining a hydrogen decrepitated material with a particle size of 50-300 μm, wherein the activation treatment was conducted at 100° C. for 40 min, the hydrogen absorption treatment was conducted at a pressure of 0.088 Pa, and for 600 kg of the strip casting alloy flake, the hydrogen absorption treatment was conducted for 1 h; the dehydrogenation treatment was conducted at 580° C., and for 600 kg of the strip casting alloy flake, the dehydrogenation treatment was conducted for 3 h; the hydrogen decrepitated material and an organic antioxidant were fully stirred for 60 min in a fully automatic three-dimensional mixer, during which the mixer had a tank wall temperature of 40° C., obtaining a first mixed material; the mass of the organic antioxidant was 0.35%0 of that of the hydrogen decrepitated material;

The first mixed material was subjected to a powdering with a jet mill in an atmosphere with an oxygen supplement less than 10 ppm at a rotational speed of a classifying wheel of 4300 r/min, obtaining a powdered alloy with an average particle size d [5,0] of 3.8 μm and a particle size distribution d [9,0]/d [1,0] of 4.0; the powdered alloy and an organic lubricant were fully stirred in a fully automatic three-dimensional mixer for 90 min, during which the mixer had a tank wall temperature of 40° C., obtaining a second mixed material, wherein the mass of the organic lubricant was 0.45%0 of that of the powdered alloy.

The second mixed material was placed in a magnetic field pressure equipment and subjected to an orientation molding at a magnetic flux density of 2 T, and then the resulting mixture was subjected to a cold isostatic pressing treatment (at a pressure of 250 MPa, held for 30 s), obtaining a green body with a density of 3.9 g/cm$^3$.

The green body was placed in a sintering furnace with a vacuum degree not higher than $3\times10^{-2}$ Pa and subjected to a sintering, which is specifically conducted as follows: the temperature in the sintering furnace was increased from ambient temperature (25° C.) to 1075° C. at a heating rate of 4° C./min, and the body was held for 6 h at this temperature, obtaining a sintered material; then the temperature was reduced to 75° C. at a cooling rate of 18° C./min, then increased to 900° C. at a heating rate of 8° C./min, the sintered material was held for 4 h at this temperature for a first tempering treatment; then the temperature was reduced to 75° C. at a cooling rate of 18° C./min, and then increased to 500° C. at a heating rate of 10° C./min, the resulting material after the first tempering treatment was held for 5 h at this temperature for a second tempering treatment, and finally the temperature was reduced to 25° C. at a cooling rate of 13° C./min, obtaining the neodymium-iron-boron permanent magnet.

Test Example 1

The neodymium-iron-boron permanent magnets prepared in Examples 1 to 3 and Comparative Example 1 were subjected to a φ10×10 cylindrical test at 20° C., for specifically measuring the remanence (Br), magnetic induction coercive force (Hcb), and intrinsic coercive force (Hcj), magnetic energy product ((BH)max), reverse magnetic field (Hk) at J=0.9Jr on the J demagnetization curve of the magnet and squareness (Hk/Hcj); at the same time, the contents of C and O in each neodymium-iron-boron permanent magnet were determined. The obtained test data is shown in Table 1, wherein the data for "powder temperature (° C.)" in Table 1 represents the tank wall temperature of the mixer during the mixing process. It can be seen from Table 1 that in the present disclosure, Ga, In and Sn are added into the neodymium-iron-boron permanent magnet without any additional organic additive, thus significantly reducing the contents of C and O, and a green body with a higher density could be obtained without any additional cold isostatic pressing after molding, and finally a neodymium-iron-boron permanent magnet with excellent comprehensive performance is obtained.

TABLE 1

Comparison of magnetic properties at 20° C. and the contents of C and O of the neodymium-iron-boron permanent magnets prepared in Examples 1 to 3 and Comparative Example 1.

| Test index | Example 1 | Example 2 | Example 3 | Comparative Example 1 |
|---|---|---|---|---|
| Powder temperature (° C.) | 19 | 17 | 16 | 40 |
| Density of green body (g/cm$^3$) | 4.21 | 4.24 | 4.29 | 3.90 |
| Br (kGs) | 14.52 | 14.47 | 14.44 | 14.60 |
| Hcj (kOe) | 16.85 | 17.90 | 18.51 | 16.22 |
| Hcb (kOe) | 14.12 | 14.07 | 14.03 | 14.19 |
| (BH)max (MGOe) | 50.52 | 50.06 | 49.85 | 51.02 |
| Hk/Hcj | 0.985 | 0.987 | 0.985 | 0.980 |
| C (ppm) | 215.5 | 235.5 | 238.6 | 753.2 |
| O (ppm) | 523.2 | 518.5 | 495.8 | 865.3 |

Example 4

A neodymium-iron-boron permanent magnet was prepared according to the method of Example 1, except that the strip casting alloy flake used had a composition of $[0.05Tb0.95(Pr_{25}Nd_{75})]_{29.6}(Fe_{98.47}Co_{1.2}Cu_{0.15}Zr_{0.18})_{69.45}B_{0.95}$, and the mass of the liquid alloy $Ga_{65}In_{20}Sn_{15}$ used in this example was 0.2% of that of the powdered alloy.

Example 5

A neodymium-iron-boron permanent magnet was prepared according to the method of Example 4, except that the mass of the liquid alloy $Ga_{65}In_{20}Sn_{15}$ was 0.35% of that of the powdered alloy, and during the mixing process of the powdered alloy and the liquid alloy $Ga_{65}In_{20}Sn_{15}$, the mixer had a tank wall temperature of 18° C.

Example 6

A neodymium-iron-boron permanent magnet was prepared according to the method of Example 4, except that the mass of the liquid alloy $Ga_{65}In_{20}Sn_{15}$ was 0.45% of that of the powdered alloy, and during the mixing process of the powdered alloy and the liquid alloy $Ga_{65}In_{20}Sn_{15}$, the mixer had a tank wall temperature of 16° C.

Comparative Example 2

A neodymium-iron-boron permanent magnet was prepared according to the method of Comparative Example 1, except that the strip casting alloy flake used had a composition of $[0.05Tb0.95(Pr_{25}Nd_{75})]_{29.6}(Fe_{98.47}Co_{1.2}Cu_{0.15}Zr_{0.18})_{69.45}B_{0.95}$.

Test Example 2

According to the method of Test Example 1, the neodymium-iron-boron permanent magnets prepared in Examples 4 to 6 and Comparative Example 2 were tested for performance, and the obtained test data is shown in Table 2, wherein the date for "powder temperature (° C.)" in Table 2 represents the tank wall temperature of the mixer during the mixing process. It can be seen from Table 2 that in the present disclosure, Ga, In and Sn are added into the neodymium-iron-boron permanent magnet without any additional organic additive, thus significantly reducing the contents of C and O, and a green body with a higher density could be obtained without any additional cold isostatic pressing after molding, and finally a neodymium-iron-boron permanent magnet with excellent comprehensive performance is obtained.

TABLE 2

Comparison of magnetic properties at 20° C. and the contents of C and O of the neodymium-iron-boron permanent magnets prepared in Examples 4 to 6 and Comparative Example 2.

| Test index | Example 4 | Example 5 | Example 6 | Comparative Example 2 |
|---|---|---|---|---|
| Powder temperature (° C.) | 19 | 18 | 16 | 40 |
| Density of green body (g/cm$^3$) | 4.23 | 4.23 | 4.24 | 3.95 |
| Br (kGs) | 14.57 | 14.54 | 14.49 | 14.65 |
| Hcj (kOe) | 18.02 | 18.61 | 18.83 | 17.04 |
| Hcb (kOe) | 14.16 | 14.11 | 14.08 | 14.23 |
| (BH)max (MGOe) | 50.72 | 50.52 | 50.16 | 51.29 |
| Hk/Hcj | 0.986 | 0.985 | 0.988 | 0.984 |
| C (ppm) | 235.8 | 225.3 | 218.5 | 765.8 |
| O (ppm) | 520.6 | 508.7 | 489.2 | 875.2 |

Example 7

A neodymium-iron-boron permanent magnet was prepared according to the method of Example 1, except that the strip casting alloy flake used had a composition of $[0.02Tb0.98(Pr_{25}Nd_{75})]_{29.8}(Fe_{98.4}Co_{1.2}Cu_{0.2}Zr_{0.2})_{69.25}B_{0.95}$, the mass of the liquid alloy $Ga_{65}In_{20}Sn_{15}$ used in this example was 0.2% of that of the powdered alloy, and during the mixing process of the powdered alloy and the liquid alloy $Ga_{65}In_{20}Sn_{15}$, the mixer had a tank wall temperature of 18° C.

Example 8

A neodymium-iron-boron permanent magnet was prepared according to the method of Example 7, except that the mass of the liquid alloy $Ga_{65}In_{20}Sn_{15}$ was 0.35% of that of the powdered alloy, and during the mixing process of the powdered alloy and the liquid alloy $Ga_{65}In_{20}Sn_{15}$, the mixer had a tank wall temperature of 16° C.

Example 9

A neodymium-iron-boron permanent magnet was prepared according to the method of Example 7, except that the mass of the liquid alloy $Ga_{65}In_{20}Sn_{15}$ was 0.45% of that of the powdered alloy, and during the mixing process of the powdered alloy and the liquid alloy $Ga_{65}In_{20}Sn_{15}$, the mixer had a tank wall temperature of 16° C.

Comparative Example 3

A neodymium-iron-boron permanent magnet was prepared according to the method of Comparative Example 1, except that the strip casting alloy flake used had a composition of $[0.02Tb0.98(Pr_{25}Nd_{75})]_{29.8}(Fe_{98.4}Co_{1.2}Cu_{0.2}Zr_{0.2})_{69.25}B_{0.95}$, and during the mixing process of the first mixed material and the second mixed material, the mixer had a tank wall temperature of 38° C.

Test Example 3

According to the method of Test Example 1, the neodymium-iron-boron permanent magnets prepared in Examples 7 to 9 and Comparative Example 3 were tested for performance, and the obtained test data is shown in Table 3, wherein the data of "powder temperature (° C.)" in Table 3 represents the tank wall temperature of the mixer during the mixing process. It can be seen from Table 3 that in the present disclosure, Ga, In and Sn are added into the neodymium-iron-boron permanent magnet without any additional organic additive, thus significantly reducing the contents of C and O, and a green body with a higher density could be obtained without any additional cold isostatic pressing after molding, and finally a neodymium-iron-boron permanent magnet with excellent comprehensive performance is obtained.

TABLE 3

Comparison of magnetic properties at 20° C. and the contents of C and O of the neodymium-iron-boron permanent magnets prepared in Examples 7 to 9 and Comparative Example 3.

| Test index | Example 7 | Example 8 | Example 9 | Comparative Example 3 |
|---|---|---|---|---|
| Powder temperature (° C.) | 18 | 16 | 16 | 38 |
| Density of green body (g/cm$^3$) | 4.23 | 4.25 | 4.27 | 3.88 |
| Br (kGs) | 14.60 | 14.53 | 14.47 | 14.68 |
| Hcj (kOe) | 17.51 | 18.02 | 18.72 | 16.68 |
| Hcb (kOe) | 14.20 | 14.09 | 14.06 | 14.28 |
| (BH)max (MGOe) | 50.95 | 50.32 | 49.96 | 51.51 |
| Hk/Hcj | 0.984 | 0.983 | 0.985 | 0.982 |
| C (ppm) | 230.2 | 215.8 | 198.2 | 775.5 |
| O (ppm) | 525.3 | 509.6 | 485.6 | 885.6 |

Example 10

A neodymium-iron-boron permanent magnet was prepared according to the method of Example 1, except that the strip casting alloy flake used had a composition of $[0.01Tb0.025Dy_{0.965}(Pr_{25}Nd_{75})]_{29.8}(Fe_{98.4}Co_{1.2}Cu_{0.2}Zr_{0.2})_{69.25}B_{0.95}$, the mass of the liquid alloy $Ga_{65}In_{20}Sn_{15}$ used in this example was 0.2% of that of the powdered alloy, and during the mixing process of the powdered alloy and the liquid alloy $Ga_{65}In_{20}Sn_{15}$, the mixer had a tank wall temperature of 20° C.

Example 11

A neodymium-iron-boron permanent magnet was prepared according to the method of Example 10, except that the mass of the liquid alloy $Ga_{65}In_{20}Sn_{15}$ was 0.35% of that of the powdered alloy, and during the mixing process of the powdered alloy and the liquid alloy $Ga_{65}In_{20}Sn_{15}$, the mixer had a tank wall temperature of 15° C.

Example 12

A neodymium-iron-boron permanent magnet was prepared according to the method of Example 10, except that the mass of the liquid alloy $Ga_{65}In_{20}Sn_{15}$ was 0.45% of that of the powdered alloy, and during the mixing process of the powdered alloy and the liquid alloy $Ga_{65}In_{20}Sn_{15}$, the mixer had a tank wall temperature of 17° C.

Comparative Example 4

A neodymium-iron-boron permanent magnet was prepared according to the method of Comparative Example 1, except that the strip casting alloy flake used had a composition of $[0.01Tb0.025Dy_{0.965}(Pr_{25}Nd_{75})]_{29.8}(Fe_{98.4}Co_{1.2}Cu_{0.2}Zr_{0.2})_{69.25}B_{0.95}$, and during the mixing process of the first mixed material and the second mixed material, the mixer had a tank wall temperature of 42° C.

Test Example 4

According to the method of Test Example 1, the neodymium-iron-boron permanent magnets prepared in Examples 10 to 12 and Comparative Example 4 were tested for performance, the obtained test data is shown in Table 4, wherein the data for "powder temperature (° C.)" in Table 4 represent the tank wall temperature of the mixer during the mixing process. It can be seen from Table 4 that in the present disclosure, Ga, In and Sn are added into the neodymium-iron-boron permanent magnet without any additional organic additive, thus significantly reducing the contents of C and O, and a green body with a higher density could be obtained without any additional cold isostatic pressing after molding, and finally a neodymium-iron-boron permanent magnet with excellent comprehensive performance is obtained.

TABLE 4

Comparison of magnetic properties at 20° C. and the contents of C and O of the neodymium-iron-boron permanent magnets prepared in Examples 10 to 12 and Comparative Example 4.

| Test index | Example 10 | Example 11 | Example 12 | Comparative Example 4 |
|---|---|---|---|---|
| Powder temperature (° C.) | 20 | 15 | 17 | 42 |
| Density of green body ($g/cm^3$) | 4.23 | 4.25 | 4.27 | 3.88 |
| Br (kGs) | 14.53 | 14.48 | 14.45 | 14.58 |
| Hcj (kOe) | 17.01 | 17.42 | 17.72 | 16.60 |
| Hcb (kOe) | 14.20 | 14.09 | 14.06 | 14.28 |
| (BH)max (MGOe) | 50.48 | 50.12 | 49.92 | 50.92 |
| Hk/Hcj | 0.989 | 0.980 | 0.982 | 0.976 |
| C (ppm) | 220.2 | 200.3 | 215.0 | 782.3 |
| O (ppm) | 525.2 | 500.1 | 515.3 | 900.2 |

The above are only the preferred embodiments of the present disclosure. It should be noted that for those of ordinary skill in the art, without departing from the principle of the present disclosure, a plurality of improvements and modifications could be made, and these improvements and modifications should also be regarded as falling within the protection scope of the present disclosure.

What is claimed is:

1. A neodymium-iron-boron permanent magnet, having a composition represented by formula I:

$$[mHR(1-m)(Pr_{25}Nd_{75})]_x(Fe_{100-a-b-c-d}M_aGa_bIn_cSn_d)_{100-x-y}B_y \quad \text{formula I;}$$

where a is 0.995-3.493, b is 0.114-0.375, c is 0.028-0.125, d is 0.022-0.100; x is 29.05-30.94, y is 0.866-1.000; m is 0.02-0.05;

HR is Dy and/or Tb; and

M is at least one selected from the group consisting of Co, Cu, Ti, Al, Nb, Zr, Ni, W and Mo.

2. A method for preparing the neodymium-iron-boron permanent magnet of claim 1, comprising the following steps:

providing a strip casting alloy flake and a liquid alloy according to a composition of the neodymium-iron-boron permanent magnet, wherein the strip casting alloy flake consists of HR, Pr, Nd, Fe, M and B, and the liquid alloy consists of Ga, In and Sn;

sequentially subjecting the strip casting alloy flake to a hydrogen decrepitation and a powdering with a jet mill, to obtain a powdered alloy; and mixing the powdered alloy with the liquid alloy to obtain a mixed material, and sequentially subjecting the mixed material to an orientation molding, a sintering, and a tempering treatment, to obtain the neodymium-iron-boron permanent magnet.

3. The method of claim 2, wherein the liquid alloy has a composition of $Ga_eIn_fSn_g$, where e is 57-75, f is 14-25, and g is 11-18.

4. The method of claim 2, wherein the liquid alloy is prepared by a process comprising the following steps:

mixing metals Ga, In and Sn in a protective atmosphere with a pressure of 0.05-0.15 MPa and an content of oxygen less than 0.02% at a temperature of 25-35° C., to obtain the liquid alloy.

5. The method of claim 2, wherein the hydrogen decrepitation comprises an activation treatment, a hydrogen absorption treatment, and a dehydrogenation treatment in sequence, wherein the activation treatment is conducted at 80-150° C. for 30-60 min;

the hydrogen absorption treatment is conducted at a pressure not higher than 0.088 Pa, and for 600 kg of the strip casting alloy flake, the hydrogen absorption treatment is conducted for 50-70 min; and the dehydrogenation treatment is conducted at 480-650° C., and for 600 kg of the strip casting alloy flake, the dehydrogenation treatment is conducted for 2-5 h.

6. The method of claim 2, wherein the powdering with a jet mill is conducted in an atmosphere with an oxygen supplement less than 10 ppm at a rotational speed of a classifying wheel of 4200-4300 r/min; the powdered alloy obtained after the powdering with a jet mill has an average particle size d [5,0] of 3.5-4.5 pm, and a particle size distribution d [9,0]/d [1,0] of 3.8-4.2.

7. The method of claim 2, wherein the orientation molding is conducted at a magnetic flux density of 1.5-2 T; and a green body obtained after the orientation molding has a density of 4.2-4.5 $g/cm^3$.

8. The method of claim 2, wherein the sintering is conducted under a vacuum degree not higher than 3×10−3 Pa and at a temperature of 1030-1100° C. for 2-8 h.

9. The method of claim 2, wherein the tempering treatment comprises a first tempering treatment and a second tempering treatment in sequence; the first tempering treatment is conducted at a temperature of 850-920° C. for 2-5 h, and the second tempering treatment is conducted at a temperature of 470-550° C. for 3-8 h.

10. A method of using the neodymium-iron-boron permanent magnet of claim 1, comprising applying the neodymium-iron-boron permanent magnet in electronic information products or new energy automobile motor products.

11. The method of claim 3, wherein the liquid alloy is prepared by a process comprising the following steps:

mixing metals Ga, In and Sn in a protective atmosphere with a pressure of 0.05-0.15 MPa and an content of oxygen less than 0.02% at a temperature of 25-35° C., to obtain the liquid alloy.

* * * * *